US005298702A

United States Patent [19]

Duffour et al.

[11] Patent Number: 5,298,702

[45] Date of Patent: Mar. 29, 1994

[54] PRESSURE MEDIUM DRIVE FOR CLOSING AND OPENING THE CONTACTS OF A CIRCUIT-BREAKER

[75] Inventors: Henri Duffour, Evian; Philippe Goerend, St. Genis-Pouilly both of France; Dominique Loutan, Genève, Switzerland

[73] Assignee: Secheron SA, Geneva, Switzerland

[21] Appl. No.: 941,306

[22] Filed: Sep. 4, 1992

[30] Foreign Application Priority Data

Sep. 6, 1991 [CH] Switzerland ..... 2632/91

[51] Int. Cl.[5] ..... H01H 35/38

[52] U.S. Cl. ..... 200/82 R; 91/459; 137/557; 137/625.66

[58] Field of Search ..... 92/5 R, 1 S; 91/1, 394, 91/396, 417 R, 459; 251/12, 62; 137/538, 554, 557, 625.64, 625.66; 200/81 R, 82 R, 82 B, 148 R

[56] References Cited

U.S. PATENT DOCUMENTS 2,381,307 8/1945 Peek et al. .
2,384,801 9/1945 Cumming et al. .
2,730,590 1/1956 Kelle .
4,343,972 8/1982 Bischofberger ..... 200/81 R

FOREIGN PATENT DOCUMENTS 258804 4/1913 Fed. Rep. of Germany .
3616914A1 11/1987 Fed. Rep. of Germany .
2193242 2/1974 France .
2193243 2/1974 France .
524729 8/1949 United Kingdom .
840977 7/1966 United Kingdom ..... 200/82 R

*Primary Examiner*—Gerald P. Tolin
*Attorney, Agent, or Firm*—Burns, Doane, Swecker & Mathis

[57] ABSTRACT

The pressure medium drive is provided for opening and closing the contacts ($e_1$, $e_2$) of an electric circuit-breaker. It contains a pressure medium reservoir (r), a drive piston (t) which slides in a drive cylinder (c) and acts on a mechanism (j) for displacing a movable contact ($e_1$) of the circuit-breaker, and a reversing valve (s) for the selective connection of the pressure medium reservoir (r) to the drive cylinder (c) or of the drive cylinder (c) to an outlet volume for the pressure medium.

This pressure medium drive is of simple, inexpensive construction and can open the contacts of the circuit-breaker considerably faster than it can close them.

This is due to an interposed valve (v) which is disposed between the pressure medium reservoir (r) and the reversing valve (s) and has a flow cross section determined by the closing time of the contacts ($e_1$, $e_2$), and to the much larger flow cross section of the reversing valve (s). This interposed valve (v) is open when closing the contacts ($e_1$, $e_2$) and passes pressure medium from the pressure medium reservoir (r) via the reversing valve (s) into the drive cylinder (c). After closing of the contacts ($e_1$, $e_2$), it is closed and then establishes the connection between the drive cylinder (c) and the outlet volume by reversing the reversing valve (s).

12 Claims, 1 Drawing Sheet

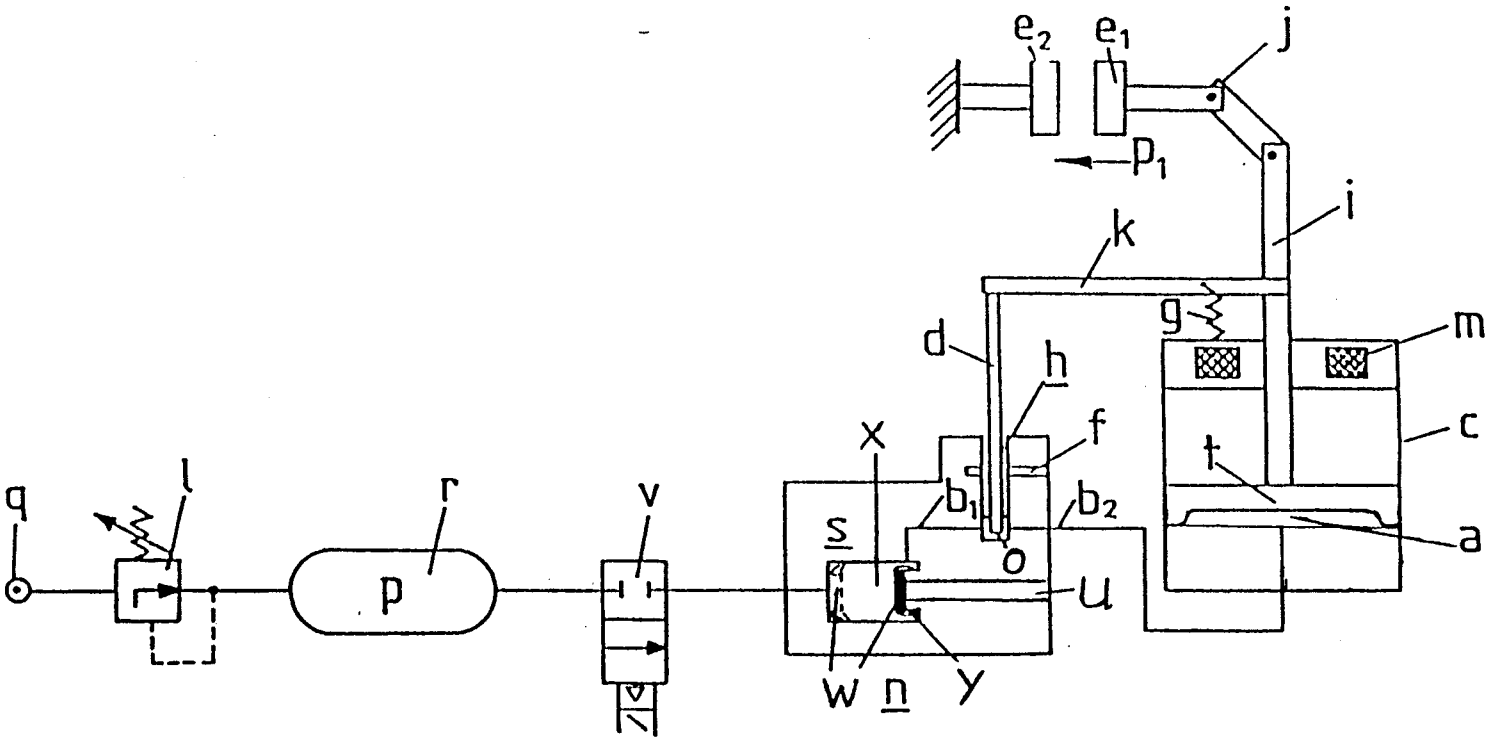
m
c
a
i
j
g
t
e1
p1
k
e2
f
b2
u
h
o
d
b1
y
x
n
s
w
v
r
p
l
q

PRESSURE MEDIUM DRIVE FOR CLOSING AND OPENING THE CONTACTS OF A CIRCUIT-BREAKER

BACKGROUND OF THE INVENTION

1. Field of the Invention

The starting point of the invention is a pressure medium drive for opening and closing the contacts of a circuit-breaker, containing a pressure medium reservoir, a drive cylinder, a drive piston sliding in the drive cylinder, a mechanism, acted on by the drive piston, to move one of the circuit-breaker contacts which is movable, and a reversing valve for connecting the pressure medium reservoir to the drive cylinder when closing the contacts and for connecting the drive cylinder to an outlet volume when opening the contacts.

2. Discussion of Background

A pressure medium drive of this kind is described in U.S. Pat. No. 2,384,801 A. This pressure medium drive has a piston 17 which is guided in a cylinder 15 and via a piston rod 49 and a linkage 50 acts on a movable contact of a circuit-breaker. To close the contacts of the circuit-breaker, compressed air is fed to the cylinder 15 via an electromagnetically operated reversing valve 21 and a throttle valve 23 from a compressed air reservoir connected to a chamber 186 of the reversing valve 21. The compressed air passed into the cylinder 15 displaces the piston 17 and thus closes the contacts and loads a restoring spring 52 which opens the contacts in the switching-off operation. The reversing valve 21 contains an inlet valve 185, via which the compressed air is passed into the cylinder 15 in the switching-on operation, and also an outlet valve 193, via which air is vented to the atmosphere from the cylinder 15 when opening the contacts with the inlet valve 185 closed. The flow cross sections of the inlet and outlet valves are roughly equal in size and adapted to the period of time needed for closing the contacts and loading the restoring spring 52. In the event of short-circuit switch-off, the time allowed for the opening of the contacts is however substantially shorter than for closing. The pressure medium drive according to the prior art therefore has additionally another electromagnetically operated valve 25 which has a substantially larger flow cross section than the inlet or outlet valve. The time required for opening the contacts is thus substantially shortened. However, a valve of this kind is expensive because of its large flow cross section.

SUMMARY OF THE INVENTION

Accordingly, one object of the invention, as the latter is defined in patent claim 1, is to provide a novel electric circuit-breaker a pressure medium drive which is of simple, inexpensive construction but nevertheless is able to open the contacts of the circuit-breaker considerably faster than it can close them.

The pressure medium drive according to the invention is distinguished in that, in addition to the reversing valve already present it has only a simple electromagnetically operable interposed valve which has a small flow cross section. In a switching operation of the circuit-breaker this interposed valve actuates the reversing valve with the pressure medium. Compared with the interposed valve, the reversing valve can therefore have a substantially larger flow cross section. It is only when closing the contacts of the circuit-breaker that pressure medium is passed via the interposed valve and the reversing valve. When opening the contacts of the circuit-breaker, on the other hand, pressure medium is passed only via the reversing valve, which has a large flow cross section. The opening of the contacts can therefore also be effected without an electromagnetically operated valve which has a large flow cross section being provided in addition to the reversing valve. When switching-off, therefore, rapid escaping of pressure medium from the drive cylinder and thus particularly short switch-off times are ensured.

Since the interposed valve acts on the reversing valve via the pressure medium, the reversing valve can be manufactured particularly inexpensively, for example by installing a valve body which can be actuated in dependence on the direction of flow of the pressure medium.

A particularly advantageous further development of the pressure medium drive according to the invention has a control device varying the flow of the pressure medium through the reversing valve in a simple, reliable manner in dependence on the position of the drive piston. By this means, among other things, damped movement of the contacts of the circuit-breaker is achieved both when switching on and when switching off.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, in which the single FIGURE shows a schematic plan view, partly in section, of a pressure medium drive according to the invention when closing the electric circuit-breaker.

DESCRIPTION OF THE PREFERRED EMBODIMENTS

The pressure medium drive shown in the FIGURE has a drive cylinder c, a multifunction block n and a pressure medium reservoir r containing pressure medium, such as in particular compressed air, at the pressure p, the inlet of which reservoir is in communication via a pressure regulator 1 with a pressure medium source q, while its outlet can be opened and closed by an electromagnetically operable interposed valve v. The multifunction block n is disposed between the interposed valve v and a chamber a of the drive cylinder c and contains a reversing valve s and a control device h.

The chamber a is closed by a drive piston t guided pressure medium-tightly in the drive cylinder c. The drive piston t carries an insulating rod i, which is operatively coupled to a drive mechanism j of the circuit-breaker. A movable contact $e_1$ of two contacts $e_1$, $e_2$ of the circuit-breaker is operatively connected to the drive mechanism j. In the switched-on position of the circuit-breaker the movable contact $e_1$ rests with a contact force producing a pressure $p_1$ on a stationary contact $e_2$ of the two contacts $e_1$, $e_2$. The drive piston t and the movable contact $e_1$ are held in the switched-on position by a latching system containing an electromagnetic coil m. The latching system is continuously subjected to the force of a spring g, which is supported at one end on the drive cylinder c and at the other end on a part k rigidly connected to the insulating rod i. In the switched-off position of the circuit-breaker the contacts $e_1$, $e_2$ are separated from one another. The preloaded spring g then presses the drive piston t against the bottom of the drive cylinder c and holds the drive piston t, and thus also the movable contact $e_1$, in a defined position.

The reversing valve s has a valve body w which can be actuated in dependence on the-direction of flow of the pressure medium passing through. This valve body w is displaceably guided in a bore x in the reversing valve s. The bore x is in communication with the interposed valve v and is connected via lines $b_1$, $b_2$ to the drive cylinder c and via a quick outlet opening u to an outlet volume, such as the atmosphere, for receiving used pressure medium. The valve body w has an edge region which is configured in the style of sealing lips y and which, in dependence on the direction of flow of the pressure medium, is pressed against the quick outlet opening u (FIGURE) when closing the contacts $e_1$, $e_2$ and against the wall of the bore x (valve body w shown in dashed lines in the FIGURE) when opening the contacts.

The control device h has a member which varies the flow cross section of the lines $b_1$, $b_2$. This member is formed by a rod d, which is operatively connected to the drive piston t by means of the part k and the insulating rod i. The rod d is guided in a chamber o. It throttles the flow cross section of the lines $b_1$, $b_2$ in the switched-off position (FIGURE), that is to say when the contacts $e_1$, $e_2$ are open. The control device h also has a gap f which in the switched-off position connects the chamber o to the outlet volume for receiving used pressure medium.

During the operation of the pressure medium drive according to the invention, pressure medium, such as preferably compressed air, is passed through the pressure regulator l, which stabilizes the pressure p of the pressure medium in the pressure medium reservoir r.

In order to close the contacts $e_1$, $e_2$, the interposed valve v is first opened. Pressure medium at the pressure p then flows out of the pressure medium reservoir r via the interposed valve v into the bore x in the reversing valve s. This flow of pressure medium brings the valve body w against the quick outlet opening u. The edge region of the valve body w, configured in the style of sealing lips y, is pressed by the pressure building up in the bore x, with complete sealing in relation to the outlet volume, against the quick outlet opening u. The pressure medium is passed through the line $b_1$, the chamber o and the line $b_2$ into the chamber a of the drive cylinder c. At the beginning of the switching-on operation the rod d introduced into the chamber o (FIGURE) throttles the flow cross section of the chamber o. The pressure medium passed through the chamber o displaces the drive piston t slowly upwards. The movable contact $e_1$ is thereby displaced and at the same time the spring g is loaded and the rod d is moved out of the chamber o, thus continuously enlarging the flow cross section. After the chamber o has been freed, the drive piston t then moves at constant speed. Finally, the movable contact $e_1$ comes into engagement with the stationary contact $e_2$, thus producing a contact force $p_1$, and the drive piston t and consequently also the movable contact $e_1$ are locked by the electromagnetic force of the coil m. The rod d is then situated above the gap f. At the end of the upward movement of the drive piston t the gap f brings about the escaping of pressure medium, so that the pressure p in the chamber o and thus also in the chamber a is reduced. Through the reduction of the pressure in the chamber a of the drive cylinder c, the colliding movement of the two contacts $e_1$, $e_2$ during closing is effectively damped.

After the closing and latching of the contacts $e_1$, $e_2$, the interposed valve v is closed. Since the bore x has a very small volume in relation to the chamber a, the pressure medium pressure falling via the gap f decreases in the bore x much faster than that in the chamber a of the drive cylinder c. Consequently, the elastically deformed sealing lips y of the valve body w are lifted off the quick outlet opening u and pressure medium then also flows out of the bore x via the quick outlet opening u into the outlet volume. The pressure medium flow then starting from the chamber a of the driver cylinder c brings the sealing lips y against the wall of the bore x and displaces the valve body w completely to the left (shown in dashed lines in the FIGURE). The pressure medium located in the chamber a is removed very quickly into the outlet volume via the reversing valve s, which is now completely opened and has a large flow cross section, and the quick outlet opening u. The effect is thereby achieved that the circuit-breaker is ready within an extremely short time for a quick circuit break without an additional switch-off valve.

In order to open the contacts $e_1$, $e_2$ of the circuit-breaker, the latching is first cancelled by deenergizing the electromagnetic coil m. Through the force of the loaded spring g, the drive piston t and the movable contact $e_1$ move into the switched-off position of the circuit-breaker. Pressure medium at atmospheric pressure still remaining in the chamber a escapes via the line $b_2$, the chamber o, the line $b_1$, the bore x and the quick outlet opening u into the outlet volume, which is at atmospheric pressure. Towards the end of the stroke of the drive piston t the rod d penetrates into the chamber o and throttles the flow cross section of the lines $b_1$, $b_2$. The movement of the drive piston t, and therefore also of the contact $e_1$, is thereby effectively damped.

| LIST OF DESIGNATIONS | |
|---|---|
| a | Chamber |
| $b_1$, $b_2$ | Lines |
| c | Drive cylinder |
| d | Rod |
| $e_1$, $e_2$ | Contacts |
| f | Gap |
| g | Spring |
| h | Control device |
| i | Insulating rod |
| j | Drive mechanism |
| k | Part |
| l | Pressure regulator |
| m | Electromagnetic coil |
| n | Multifunction block |
| o | Chamber |
| p, $p_1$ | Pressures |
| q | Pressure medium source |
| r | Pressure medium reservoir |
| s | Reversing valve |
| t | Drive piston |
| u | Quick outlet opening |
| v | Interposed valve |
| w | Valve body |
| x | Bore |
| y | Sealing lips |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A pressure medium drive for opening and closing the contacts of a circuit-breaker, comprising:

a pressure medium reservoir;

a drive cylinder;

a drive piston sliding in the drive cylinder;

a mechanism, acted on by the drive piston, to move one of the circuit-breaker contacts which is movable;

a reversing valve connecting the pressure medium reservoir to the drive cylinder when closing the contacts and connecting the drive cylinder to an outlet volume when opening the contacts;

an interposed valve disposed between the pressure medium reservoir and the reversing valve which when closing the contacts is open and passes pressure medium from the pressure medium reservoir via the reversing valve into the drive cylinder and after closing of the contacts is closed, and which after it has been closed establishes the connection between the drive cylinder and the outlet volume by reversing the reversing valve; and a control device connected between the reversing valve and the drive cylinder in the path of the flow of the pressure medium for varying the flow of the pressure medium flowing between the reversing valve and the drive cylinder in dependence on the position of the drive piston.

2. A pressure medium drive as claimed in claim 1, wherein the reversing valve has a valve body which can be actuated in dependence on the direction of flow of the pressure medium passing through.

3. A pressure medium drive as claimed in claim 2, wherein the valve body is displaceably guided in a bore in the reversing valve, which bore is in communication with the interposed valve and the drive cylinder and is connected via a quick outlet opening to the outlet volume.

4. A pressure medium drive as claimed in claim 3, wherein the valve body has an edge region which is configured in the style of sealing lips and which, in dependence on the direction of flow of the pressure medium, is pressed against the quick outlet opening when closing the contacts and against the wall of the bore when opening the contacts.

5. A pressure medium drive as claimed in claim 1, wherein the control device has a member which varies the flow cross section of a line which makes the pressure medium connection between the reversing valve and the drive cylinder.

6. A pressure medium drive as claimed in claim 5, wherein the member of the control device has a rod mechanically connected to the drive piston and guided in a chamber determining the flow cross section of the line.

7. A pressure medium drive as claimed in claim 6, wherein the rod throttles the flow cross section of the line when the contacts are open.

8. A pressure medium drive as claimed in claim 7, wherein a gap is additionally provided in the control device and connects the chamber to the outlet volume for the pressure medium when the contacts are closed.

9. A pressure medium drive as claimed in claim 8, wherein the drive piston is held by a latching system when the contacts are closed.

10. A pressure medium drive as claimed in claim 8, wherein the latching system contains an electromagnetic coil.

11. A pressure medium drive as claimed in claim 9, wherein the latching system is continuously acted on by the force of a spring when the contacts are closed.

12. A pressure medium drive as claimed in claim 1, wherein the reversing valve and the control device are integrated into a multifunction block.

* * * * *